US006050407A

United States Patent [19]

Trujillo

[11] Patent Number: 6,050,407

[45] Date of Patent: Apr. 18, 2000

[54] REMOTE CONTROL COVER

[76] Inventor: Paul M. Trujillo, 25494 Eaton St., Barstow, Calif. 92311

[21] Appl. No.: 09/328,772

[22] Filed: Jun. 9, 1999

[51] Int. Cl.[7] ..... B65D 85/38

[52] U.S. Cl. ..... 206/320; 206/497; 206/459.5

[58] Field of Search ..... 206/305, 320, 206/459.5, 497, 37, 38, 730, 760, 451; 150/154; 53/441; 229/87.01, 87.06

[56] References Cited

U.S. PATENT DOCUMENTS

| | | | |
|---|---|---|---|
| D. 159,556 | 8/1950 | Soltz . | |
| D. 265,020 | 6/1982 | Silton . | |
| D. 267,290 | 12/1982 | Kurozumi . | |
| D. 280,863 | 10/1985 | Leath . | |
| D. 319,177 | 8/1991 | Dungjen . | |
| D. 320,714 | 10/1991 | Singley . | |
| D. 339,690 | 9/1993 | Takahashi et al. . | |
| D. 344,015 | 2/1994 | Jacobson . | |
| D. 345,647 | 4/1994 | Luxon . | |
| D. 355,302 | 2/1995 | Eva et al. . | |
| D. 368,095 | 3/1996 | McCallister, III . | |
| 3,033,359 | 5/1962 | Mercer | 206/38 |
| 3,135,455 | 6/1964 | Santangelo . | |
| 3,250,454 | 5/1966 | Steiger . | |
| 3,344,973 | 10/1967 | Studen . | |
| 3,404,829 | 10/1968 | Stone . | |
| 3,550,837 | 12/1970 | Erb . | |
| 3,813,017 | 5/1974 | Pimsleur . | |
| 4,006,764 | 2/1977 | Yamamoto et al. . | |
| 4,119,249 | 10/1978 | Hanson . | |
| 4,241,829 | 12/1980 | Hardy . | |
| 4,259,568 | 3/1981 | Dynesen . | |
| 4,263,951 | 4/1981 | Siegel . | |
| 4,424,841 | 1/1984 | Smith . | |
| 4,479,596 | 10/1984 | Swanson . | |
| 4,650,071 | 3/1987 | Grosshans . | |
| 4,703,160 | 10/1987 | Narishima et al. . | |
| 4,733,776 | 3/1988 | Ward . | |
| 4,739,897 | 4/1988 | Butler . | |
| 4,762,227 | 8/1988 | Patterson . | |
| 4,836,256 | 6/1989 | Meliconi . | |
| 4,901,852 | 2/1990 | King . | |
| 4,925,149 | 5/1990 | DiFrancesca . | |
| 4,928,819 | 5/1990 | Jakobsen . | |
| 4,930,635 | 6/1990 | Hotchkiss et al. . | |
| 4,953,703 | 9/1990 | Virginio | 206/451 |
| 5,021,638 | 6/1991 | Nopper et al. . | |
| 5,048,734 | 9/1991 | Long . | |
| 5,092,459 | 3/1992 | Uljanic et al. . | |
| 5,172,838 | 12/1992 | Rowell et al. . | |
| 5,316,141 | 5/1994 | Jalomo . | |
| 5,499,713 | 3/1996 | Huffer | 206/320 |

*Primary Examiner*—Jacob K. Ackun
*Assistant Examiner*—Luan K. Bui
*Attorney, Agent, or Firm*—Joseph E. Mueth

[57] ABSTRACT

A remote control unit having a front area containing control buttons and having a sheath wrapped around the control unit snugly covering at least said control buttons to prevent dirt, dust and other contaminants from reaching the control buttons, said sheath being sufficiently flexible to allow normal digital operation of said control buttons, said sheath comprising a thin flexible plastic film which is self-adherent and conformable to the major areas of the control unit, said sheath being wrapped around the control unit and overlapping at the rear of the control unit with the areas of overlap being self adhered.

17 Claims, 5 Drawing Sheets

REMOTE CONTROL COVER

BACKGROUND OF THE INVENTION

Various protective devices and covers have been proposed for covering or protecting remote control units such as are commonly used to operate television sets, CD changers and carousels, satellite receivers, stereo receivers, VCRs, cable converter boxes, AM/FM/Stereos/CD cassette portables, garage door openers, and the like. The invention is also applicable to the so-called universal remote controls.

For example, Jalomo U.S. Pat. No. 5,316,141 describes a cover for a remote control unit in the form of a box made by welding the edges of a cruciform blank. The box is adapted to have a remote control unit inserted therein. The top of the box is held shut by Velcro patches. Jalomo does not disclose that the buttons are intended to be pressed while in the case. Jalomo refers only to a protective case for storing a remote control unit.

Uljanic U.S. Pat. No. 5,092,459 discloses a transparent case for encapsulating a remote control unit. This case has an end flap which is held closed by Velcro patches. The top panel of the case has a thickness that is the same as the projection distance of each pushbutton on the remote control unit so that when the top panel is sealed on the upper face of the remote control unit, the upper face of the top panel is coplanar with the upper face or surface of the pushbuttons. The top panel has individual holes aligned to fit around the pushbuttons and a series of integral raised deflectable pads spanning the holes for registry with individual pushbuttons so that each pad can be separately pressed to operate the underlying pushbutton.

It has also been proposed to wrap a remote control unit in material such as bubble wrap or foam to provide shock-resistant or to insert the control unit in a container or case made of shock resistant material, Meliconi U.S. Pat. No. 4,836,256.

SUMMARY OF INVENTION

Briefly, the present invention comprises a remote control unit having a front area containing control buttons and having a sheath wrapped around the control unit snugly covering at least said control buttons to prevent dirt, dust and other contaminants from reaching the control buttons, said sheath being sufficiently flexible to allow normal digital operation of said control buttons, said sheath comprising a thin flexible plastic film which is self-adherent and conformable to the major areas of the control unit, said sheath being wrapped around the control unit and overlapping at the rear of the control unit with the areas of overlap being self adhered.

The protective sheath of this invention is an advance over prior art protective covers for remote control units. The protective sheath of this invention is easily made by simply cutting out a piece of thin flexible plastic film having the dimensions sufficient to wrap around the remote control with some overlap. The piece can be cut out manually or it can be die cut. The dimensions are dictated by the size and shape of the remote control unit which is normally adapted to be hand held with the lateral or short dimension being gripped in the palm of the hand and with the long or longitudinal dimension laying across the palm with each of its end extending beyond the palm.

While the thin plastic film is self adherent, it can be easily wiped clean with a damp cloth. The film sheath conforms generally to the shape of the remote control and covers at least all of the key or button area which serves to prevent dust, dirt and other contaminants from reaching the keys or entering the interior of the remote control unit. Thus, the service life of the remote control unit is extended.

DESCRIPTION OF PREFERRED EMBODIMENTS

Turning to the drawings.

Figure 1:
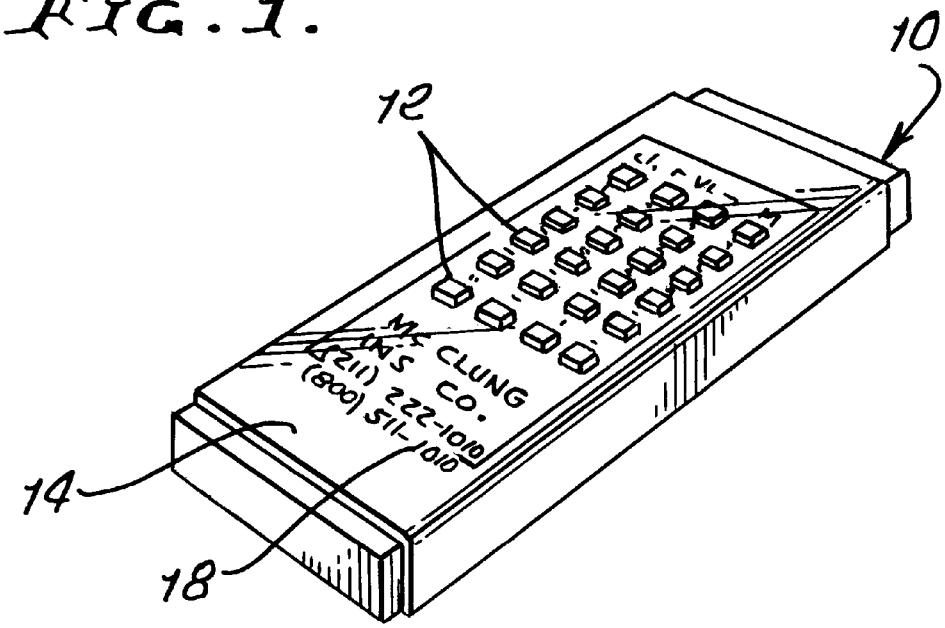
FIG. 1 is a perspective view of one preferred embodiment of this invention in which the top and two sides of a remote control unit are wrapped in the protective self-adherent film sheath of this invention.
Figure 2:
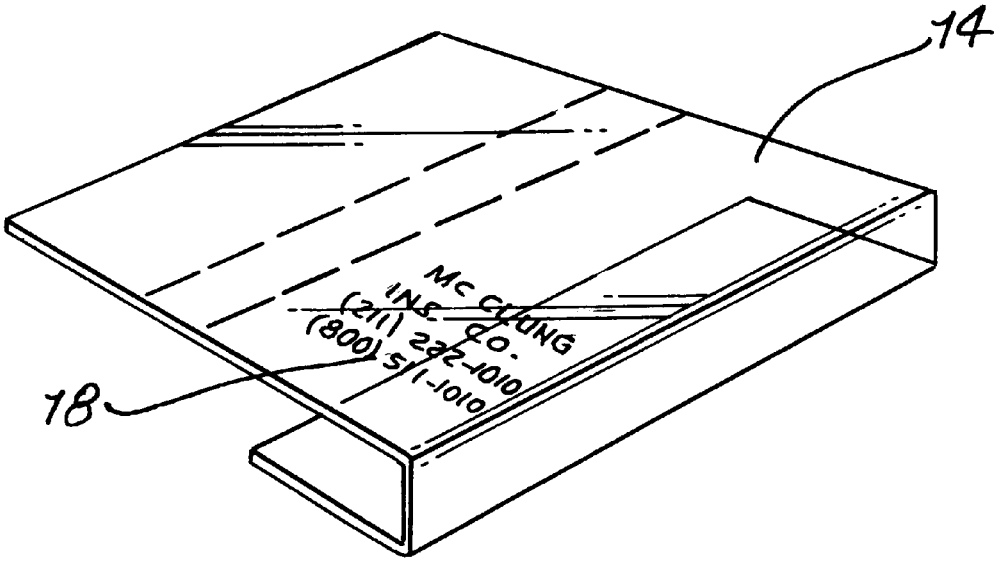
FIG. 2 is a perspective view of the sheath of FIG. 1 alone, showing the location of the bend or fold lines.
Figure 3:
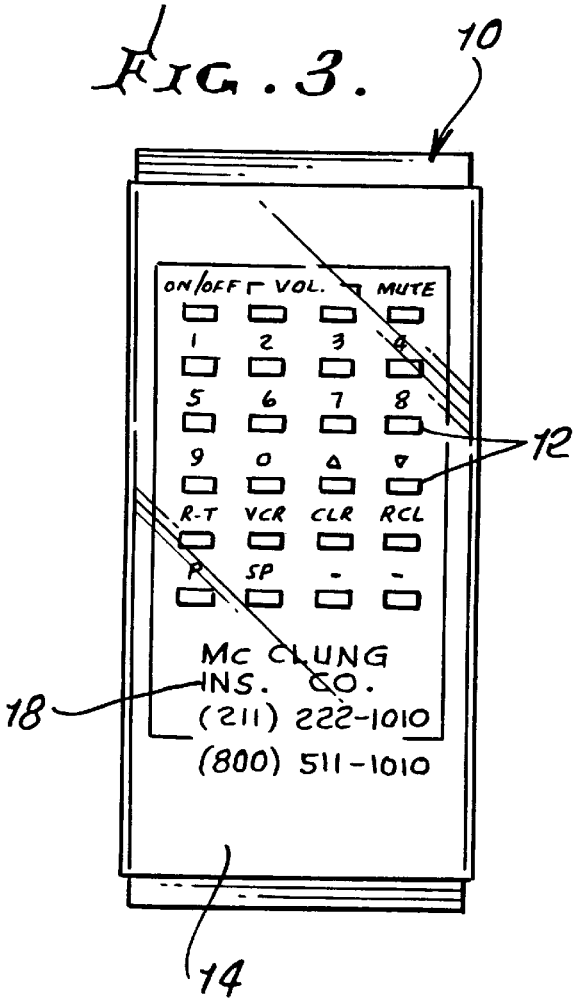
FIG. 3 is a front view of the wrapped remote control unit of FIG. 1.
Figure 4:
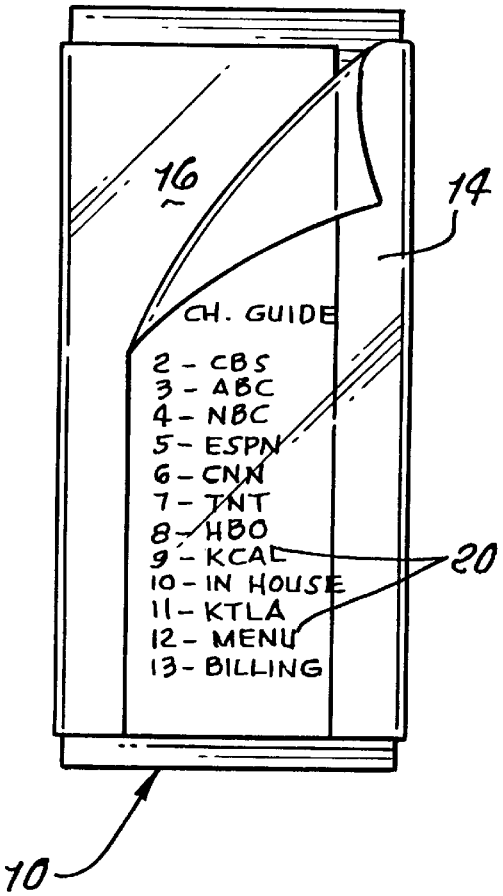
FIG. 4 is a rear view of or back view of the wrapped remote control unit to FIGS. 1 and 3.
Figure 5:
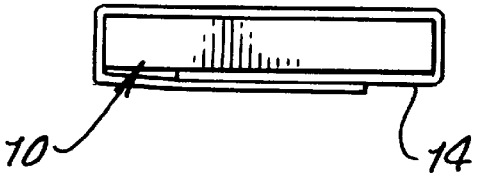
FIG. 5 is an end view of the wrapped remote control unit of FIGS. 1, 3 and 4, showing the self-adherent overlap of the thin film sheath at the rear of the remote control unit.

Turning to the drawings in more detail, FIGS. 1 to 5 show one form of common remote control unit 10 for a television sets, CD changers and carousels, satellite receivers, stereo receivers, VCRs, cable converter boxes, AM/FM/Stereos/CD cassette portables, garage door openers and the like. The unit has the usual array of keys or buttons 12 for operating a television set, CD changer and carousel, satellite receiver, stereo receiver, VCR, cable converter box, AM/FM/Stereo/CD cassette portable, garage door opener, and the like. The invention is also applicable to the so-called universal remote controls. The thin flexible plastic film 14 forming the wrap around sheath. The blank shown in FIG. 2 can be cut to size from a larger sheet of thin plastic film and then snugly wrapped around the remote control unit as shown in FIG. 4. The overlap area where the layers are superposed can be secured by simply applying light pressure to the rear of the remote control unit, causing the overlapped areas of the thin plastic film 14 to adhere to each other.

While the thin plastic film is self adherent, it is non-adherent to the operating keys or buttons so that the keys or buttons can be operated by pressing at the appropriate spot on the thin plastic film overlying the key or buttons which it is desired to depress.

Prior to wrapping, the film 14 is preferably printed with useful intelligible information such as channel identification data, advertising and virtually any other relevant form of information. The printing 18 is positioned such that when wrapped, the printed matter falls just below the key or button area. The printing 20 is likewise positioned such that the printed material falls in the center of the rear of the remote control unit.

The printed matter can be made useful in providing information in home and hotels with reference to the identification of cable service, programming menus, television repair service, in-house hotel services, and the like.

The thin plastic film 14 is generally conformable to the remote control unit without having to tightly envelope the buttons or keys since the film is sufficiently flexible so that the keys or buttons can be operated by pushing at the appropriate location on the overlying film.

Figure 6:
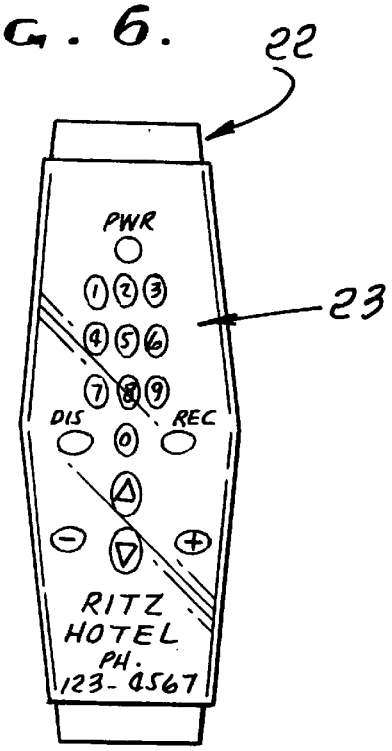
FIG. 6 is a front view of another embodiment showing a differently shaped remote control unit.
Figure 7:
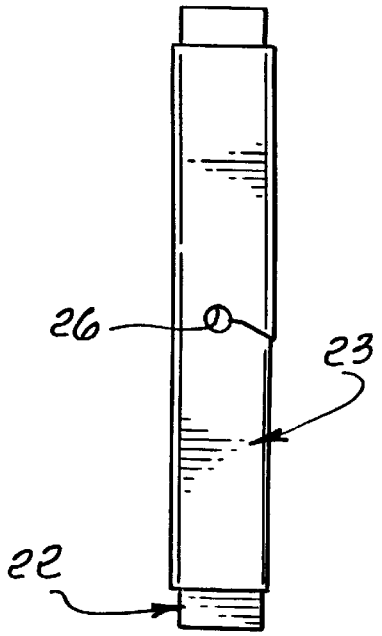
FIG. 7 is a side view of the wrapped remote control unit of FIG. 6.
Figure 8:
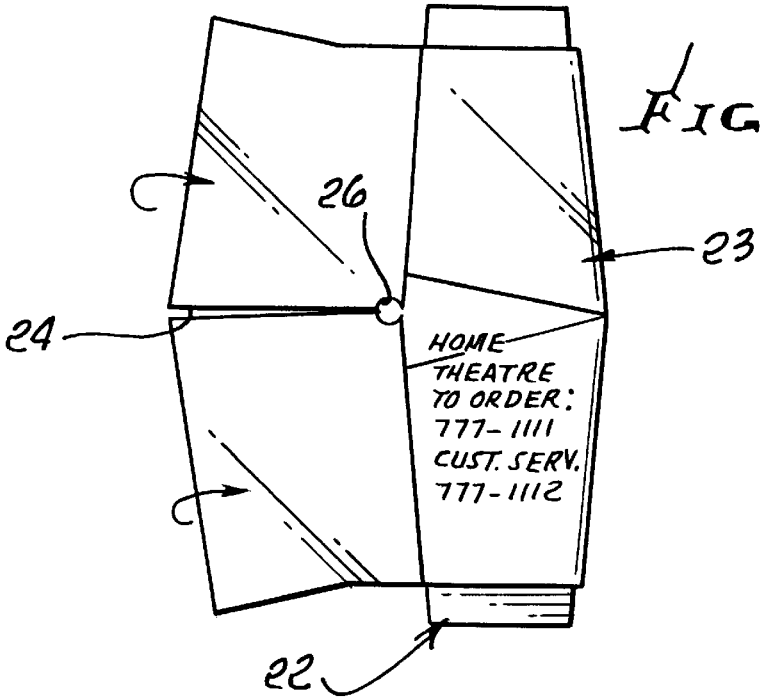
FIG. 8 is a rear view of the remote control unit of FIGS. 6 and 7 as it is being wrapped in the thin self adherent film.

FIGS. 6 to 8 show another wrapped remote control unit. The unit 22 is non-rectangular in the longitudinal dimension, requiring a tailoring of the thin plastic film 23 by the provision of slits 24 and holes 26 to allow for overlap in the longitudinal dimension. There is also overlap in the lateral dimension as in the embodiment of FIGS. 1 to 5.

Figure 9:
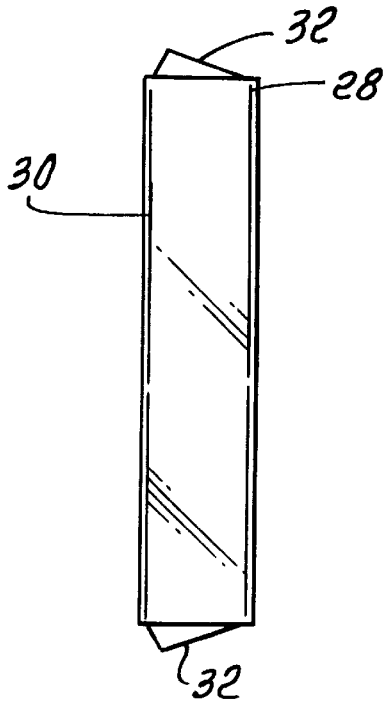
FIG. 9 is another embodiment of the invention shown in side view.
Figure 10:
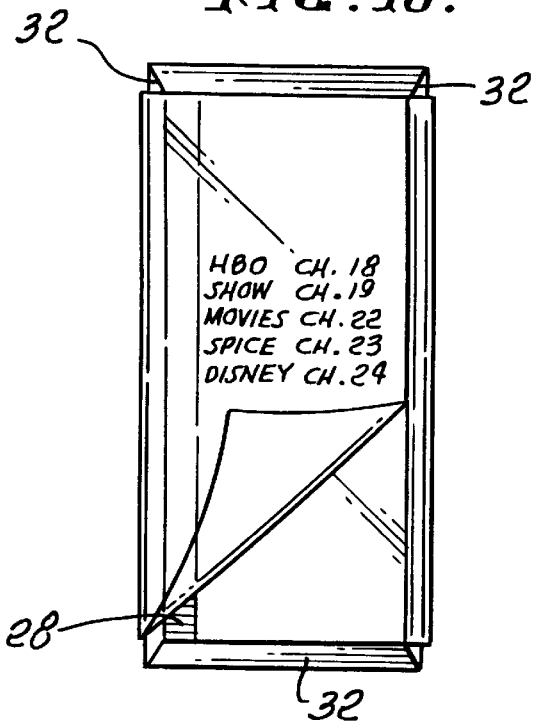
FIG. 10 is a rear view of the remote control unit of FIG. 9 just prior to completion of the wrapping of the remote control unit.

In the remote control unit of FIGS. 9 and 10, the unit has a slightly smaller front 28 area than rear area 30 so that the four edges are beveled. The wrapping is as previously described. The buttons or keys on front 28 are not shown.

Figure 11:
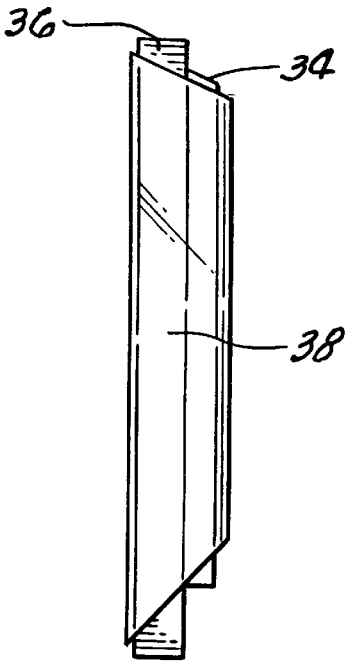
FIG. 11 is still another embodiment of the invention shown in side view.
Figure 12:
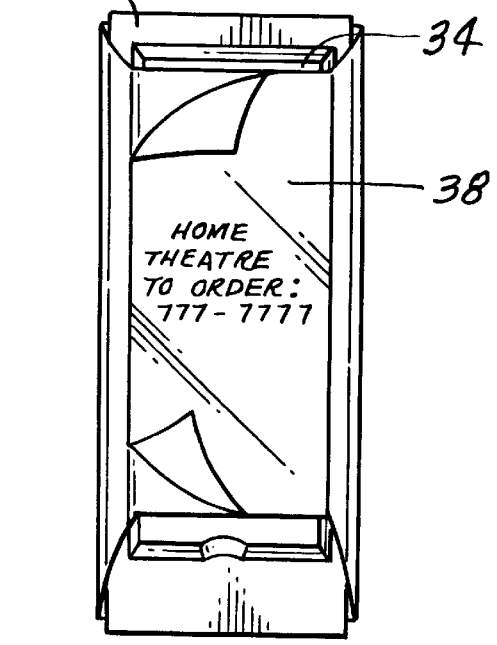
FIG. 12 is a rear view of the remote control unit of FIG. 11 also showing the final phase of wrapping in the thin self adherent film.
Figure 13:
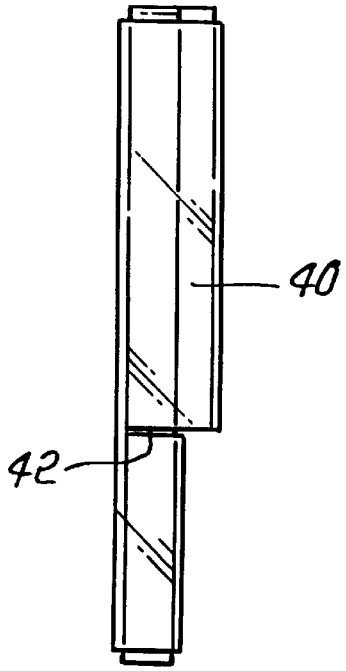
FIG. 13 is a side view of a different configured wrapped remote control unit.
Figure 14:
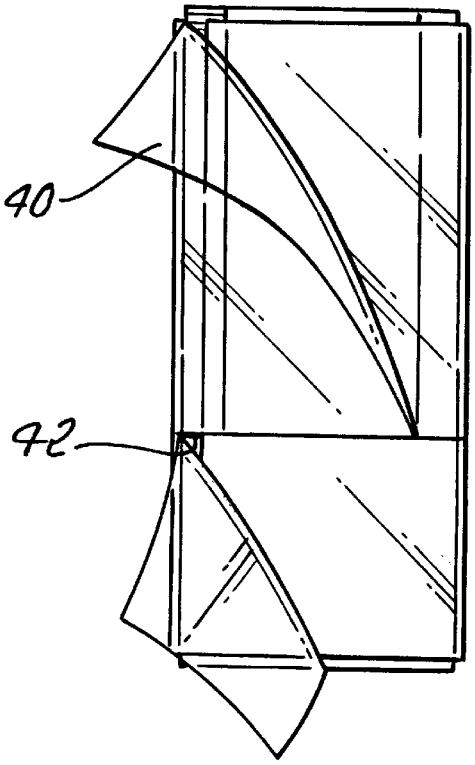
FIG. 14 shows the rear view of the remote control unit of FIG. 13 in the wrapping process.
Figure 15:
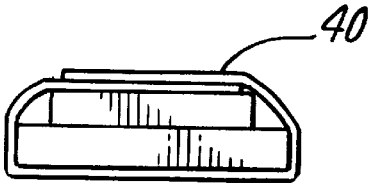
FIG. 15 is a view of one end of the embodiment of FIGS. 13 and 14.
Figure 16:
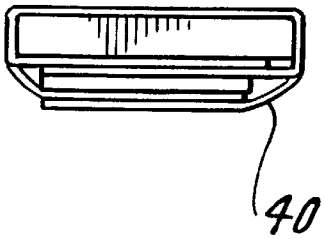
FIG. 16 is a view of the opposite end of the embodiment of FIGS. 13–15.

FIGS. 11 and 12 show an embodiment in which the back area 34 is smaller than the front area 36. The buttons or keys are not shown. The thin flexible film wrap 38 is as explained hereinabove.

FIGS. 13 to 16 shows a remote control unit which is thicker at one end than at the other end. Consequently, the thin plastic film 40 is slit at 42 to enable a snug wrapping to be obtained.

The thin self adherent plastic film is preferably a plasticized polyvinyl chloride having a thickness corresponding to a gauge from about 14 to about 30, with about 16 to about 19 gauge being the optimum thickness. Such films are available commercially from Spralding International, Inc., 200 Cahaba Valley Parkway North, Pelham, Ala. 35124. These films are available as follows:

14 Gauge—Stock No. 6028

16 Gauge—Stock No. 6014

19 Gauge—Stock No. 6015

30 Gauge—Stock No. 6024

Due to the plasticization of the film, it is self adherent and conformable without creasing. Upon wrapping, the overlapped areas are adhered to each other by light manually applied pressure.

All of these films are transparent at least in the area overlying the keys or buttons so that the identifying numerals and other data carried on or adjacent the operating buttons of the remote control unit are readily visible through the films. The film can also be permanently printed on by conventional techniques. The film can be color tinted or rendered fluorescent by incorporation of well-known additives to the plasticized film. The use of color tinting or fluorescent is desirable to facilitate the locating of the remote control unit by making it more conspicuous.

The film need not be transparent in the areas outside the key or button area. For example, in the areas outside the key or button area, the film may be opaque or rendered opaque by solid printing or coating for decorative or advertising purposes.

Having fully described the invention, it is defined by the claims.

What is claimed is:

1. A remote control unit having a front area and a rear area, the front area containing control buttons and having a sheath wrapped around the control unit snugly covering at least said control buttons to prevent dirt, dust and other contaminants from reaching the control buttons, said sheath being sufficiently flexible to allow normal digital operation of said control buttons, said sheath comprising a thin flexible, plastic film which is self-adherent and conformable to the major areas of the control unit, said sheath being wrapped around the control unit and overlapping at the rear area of the control unit with the areas of overlap being self adhered.

2. The remote control unit of claim 1 wherein the film, flexible plastic film is transparent at least in the areas overlying the control buttons.

3. The remote control unit of claim 1 wherein the unit is a television remote control.

4. The remote control unit of claim 1 wherein the unit is a garage door opener.

5. The remote control unit of claim 1 wherein the unit is a CD changer.

6. The remote control unit of claim 1 wherein the unit is a CD carousel.

7. The remote control unit of claim 1 wherein the unit is a stereo receiver.

8. The remote control unit of claim 1 wherein the unit is a VCR.

9. The remote control unit of claim 1 wherein the unit is a cable converter box.

10. The remote control unit of claim 1 wherein the unit is an AM/FM/Stereo/CD cassette portable.

11. The remote control unit of claim 1 wherein the unit is a universal remote control.

12. The remote control unit of claim 1 wherein the thin, flexible, plastic film is plasticized polyvinyl chloride.

13. The remote control unit of claim 1 wherein the thin flexible plastic film is tinted or fluorescent and transparent to render the unit conspicuous.

14. The remote control unit of claim 1 wherein the thin, flexible, transparent plastic film has a gauge thickness from about 14 to about 30 gauge.

15. The remote control unit of claim 1 wherein the thin, flexible, transparent plastic film has a gauge thickness from about 16 to about 19 gauge.

16. The remote control unit of claim 1 wherein said sheath has an area adjacent the control buttons bearing printed information in the form of advertising or operating information.

17. The remote control unit of claim 1 wherein said sheath overlying said rear area contains printed information in the form of advertising or operating information.

* * * * *